United States Patent [19]

Taketani

[11] Patent Number: 4,702,632

[45] Date of Patent: Oct. 27, 1987

[54] SHEET LOADING DEVICE AND METHOD FOR A PRINTING APPARATUS

[75] Inventor: Mitsuhiro Taketani, Tokyo, Japan

[73] Assignee: Kabushiki Kaisha Toshiba, Japan

[21] Appl. No.: 765,500

[22] Filed: Aug. 14, 1985

[30] Foreign Application Priority Data

Aug. 31, 1984 [JP] Japan ..... 59-181839
Aug. 31, 1984 [JP] Japan ..... 59-181857

[51] Int. Cl.[4] ..... B41J 13/20

[52] U.S. Cl. ..... 400/639.1; 400/550; 400/551; 400/708

[58] Field of Search ..... 400/550, 551, 624, 625, 400/629, 637.1, 639, 639.1, 639.2, 708, 708.1, 640

[56] References Cited

U.S. PATENT DOCUMENTS

| | | | |
|---|---|---|---|
| 2,566,930 | 9/1951 | Crumrine | 400/639.2 |
| 3,430,748 | 3/1969 | Parri | 400/625 |
| 4,212,456 | 7/1980 | Ruenzi | 400/629 X |
| 4,266,880 | 5/1981 | Buchanan | 400/550 |
| 4,386,864 | 6/1983 | Wang et al. | 400/639.2 X |
| 4,486,108 | 12/1984 | Tanaka | 400/639.1 |
| 4,498,795 | 2/1985 | Tatara | 400/639.1 X |
| 4,500,219 | 2/1985 | Lange et al. | 400/639.1 X |
| 4,525,089 | 6/1985 | Falconieri | 400/550 X |
| 4,540,299 | 9/1985 | Yamada | 400/639.1 X |

FOREIGN PATENT DOCUMENTS

| | | | |
|---|---|---|---|
| 0144983 | 11/1981 | Japan | 400/639.1 |
| 0162677 | 12/1981 | Japan | 400/639.1 |
| 0045084 | 3/1982 | Japan | 400/637.1 |
| 0084885 | 5/1982 | Japan | 400/639.1 |
| 0151385 | 9/1982 | Japan | 400/639.2 |
| 0024682 | 2/1984 | Japan | 400/639.1 |
| 0188464 | 10/1984 | Japan | 400/639.1 |
| WO82/01514 | 5/1982 | PCT Int'l Appl. . | |
| 2055768 | 7/1980 | United Kingdom | 400/625 |

OTHER PUBLICATIONS

IBM Technical Disclosure Bulletin, "Paper-Bail Actuation During Unattended Printout", Nilsson et al., vol. 19, No. 6, 1976, p. 1957.

IBM Technical Disclosure Bulletin, "Paper Feed Apparatus", Garrison et al., vol. 22, No. 4, Sep. 1979, pp. 1321-1322.

*Primary Examiner*—Ernest T. Wright, Jr.

*Attorney, Agent, or Firm*—Finnegan, Henderson, Farabow, Garrett & Dunner

[57] ABSTRACT

A printing apparatus is disclosed which comprises a platen roller for feeding a cut paper sheet set on a hopper, a paper bail bar having paper bail rollers used in conjunction with the platen roller to secure the cut paper sheet against the platen roller, and a paper loading mechanism for loading the cut paper sheet by causing rotation of the platen roller at a predetermined angle. The paper loading mechanism includes a paper bail switch for checking whether the paper bail roller is in contact with the platen roller. When it is detected by the paper bail switch that the paper bail roller is released from the platen roller, the platen roller is rotated in the normal direction at a first predetermined angle. When, it is detected by the paper bail switch that the paper bail rollers are in contact with the platen roller, the platen roller is rotated in the reverse direction at a second predetermined angle.

7 Claims, 13 Drawing Figures

SHEET LOADING DEVICE AND METHOD FOR A PRINTING APPARATUS

BACKGROUND OF THE INVENTION

This invention relates to a printing apparatus used with cut paper sheets and, more particularly, to improvements in an automatic paper sheet loading mechanism for such a printing apparatus.

Recently, serial printers used with cut paper sheets are finding extensive application with personal computers and word processors, as well as with data communication system terminal printers. Automatic paper sheet loading is desired for such serial printers. In the prior art, two different types of automatic cut paper sheet loading mechanism are in practical use, one for loading a plurality of cut paper sheets one after another, and the other for loading only a single cut paper sheet. The former type of loading mechanism requires, in addition to an ordinary paper feeding mechanism consisting of a platen roller or the like and a control circuit therefor, a paper feeding mechanism for feeding cut paper sheets one after another to the platen roller, a paper bail bar drive mechanism for releasing a paper bail bar from the platen roller, and a control circuit for these mechanisms. Therefore, this type of loading mechanism is inevitably large in scale, and high in price. In the latter type of loading mechanism, a cut paper sheet is set on the hopper and the paper bail bar is manually released from the platen roller. Thus, the paper feeding mechanism, paper bail bar drive mechanism and control circuit therefor are unnecessary, so that a simple and low price construction can be realized. On the demerit side, however, a load switch has to be depressed every time a cut paper sheet is loaded. Therefore, the operation is rather cumbersome compared to the former type of loading mechanism. In addition, the latter type of loading mechanism does not have means for determining the presence or absence of paper on the hopper. Therefore, idle paper feeding in the absence of paper is liable to result. In addition, erroneous paper loading caused by overlap loading of paper is likely to result from turning on the load switch again subsequent to the loading of a cut paper sheet.

SUMMARY OF THE INVENTION

An object of the invention is to provide a printing apparatus which is simple in construction and permits automatic loading of a cut paper sheet in response to a simple operation.

Another object of the invention is to provide a printing apparatus which can prevent idle feeding and erroneous loading such as overlap loading.

According to one aspect of the invention, there is provided a printing apparatus which comprises means for detecting whether a paper bail roller is in contact with a platen roller, and paper loading means for rotating the platen roller in the normal direction at a first predetermined angle when said detecting means detects that the paper bail roller is not in contact with said platen roller, and then rotating the platen roller in the reverse direction at a second predetermined angle.

According to another aspect of the invention, there is provided a printing apparatus which comprises a hopper for setting a cut paper sheet thereon, a platen roller for feeding said cut sheet set of said hopper, a paper bail bar having a paper bail roller used in conjunction with the platen roller to secure the cut paper sheet against the platen roller, first detecting means for detecting whether a cut paper sheet is set on said hopper, second detecting means for detecting whether a cut paper sheet is secured against the platen roller, third detecting means, interlocked to the paper bail roller, for detecting whether the paper bail roller is in contact with the platen roller, and paper loading means for rotating the platen roller in the normal direction at a first determined angle when said first detecting means detects that a cut paper sheet is set on the hopper, said second detecting means detects that no cut paper sheet is secured against the platen roller and said third detecting means detects that the paper bail roller is not in contact with the platen roller, and then for rotating the platen roller in the reverse direction at a second predetermined angle.

DETAILED DESCRIPTION OF THE PREFERRED EMBODIMENTS

Figure 1:
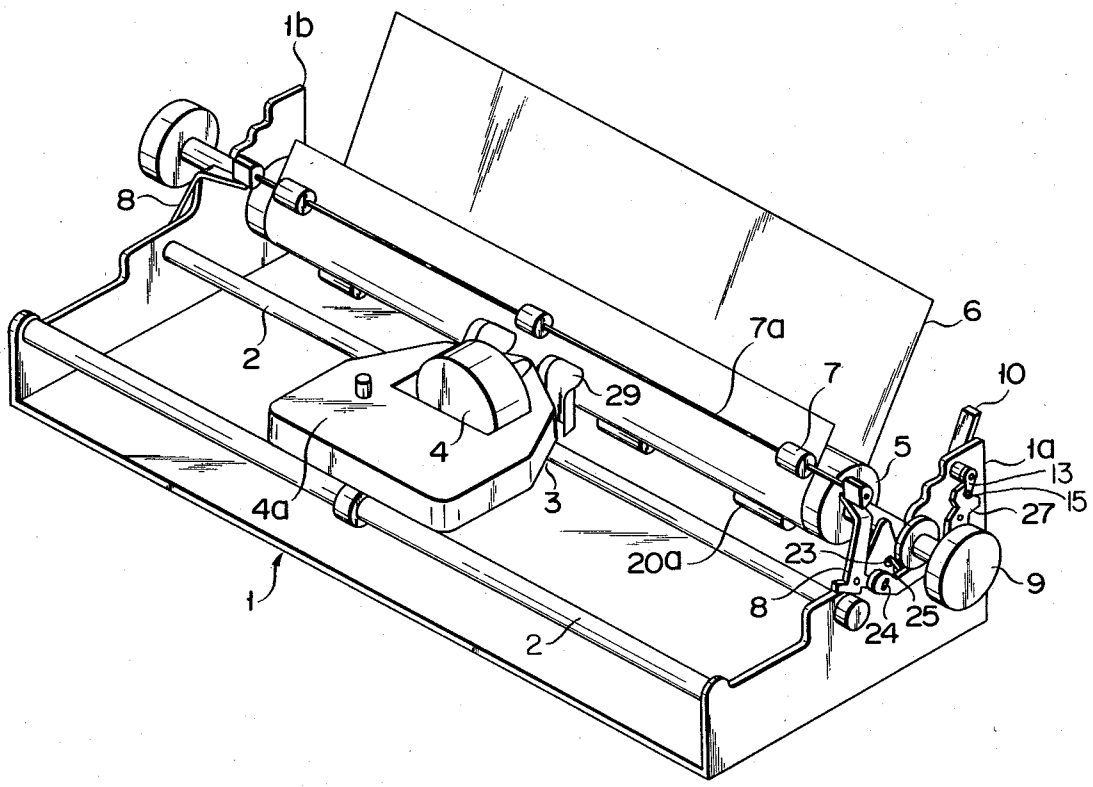
FIG. 1 is a perspective view showing the internal construction of a first embodiment of the printing apparatus according to the invention.

Now, an embodiment of the printing apparatus according to the invention will be described. FIG. 1 is a perspective view showing a first embodiment of the invention. There is shown a printer body 1 having a pair of horizontal guide bars 2 for guiding a carriage 3 with a printing head 4. While the carriage 3 is driven for reciprocal movement by a carriage motor 48 (shown diagramatically in FIG. 8), and a platen roller 5 with platen knob 9 is driven for rotation in the forward and reverse directions by a platen motor 46 (shown diagramatically in FIG. 8), printing is done by the printing head 4 on a paper sheet 6 wound on the platen roller 5. This embodiment adopts a wire-dot impact printing system using an ink ribbon cartridge 4*a* mounted on the carriage 3. The winding of the paper sheet 6 round the platen roller 5 is effected by paper bail rollers 7 which are in contact with an upper portion of the platen roller 5. The paper bail rollers 7 are rotatably mounted on a paper bail bar 7*a*. The paper bail bar 7*a* can assume two positions, i.e., one in contact with the platen roller 5 and the other not in contact with the platen roller 5. When the paper bail bar 7*a* is in contact with the platen roller 5, the paper sheet 6 is pressed against the platen roller 5 by the paper bail rollers 7. When the paper bail bar 7*a* is not in contact with the platen roller, the paper bail rollers 7 are spaced apart from the platen roller 5.

Figure 7:
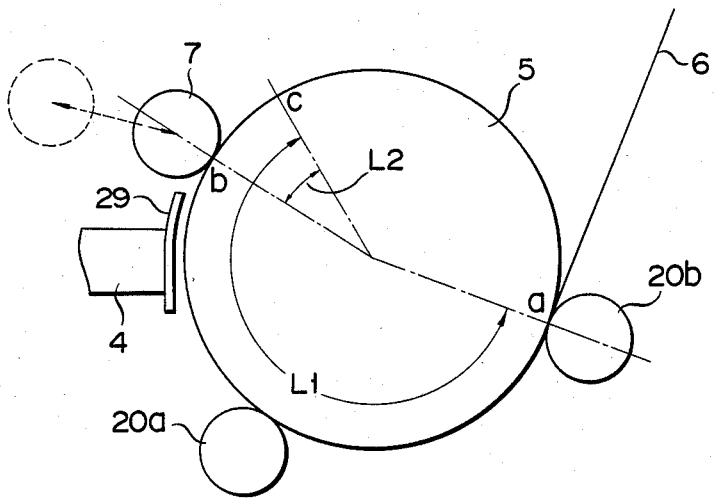
FIG. 7 is a sectional view showing the platen roller and neighboring components for illustrating a paper sheet loading operation of the first embodiment.

Friction rollers 20*a* and 20*b* are provided in contact with a lower portion of the platen roller 5 (the fricton roller 20*b* being shown in FIG. 7). The paper sheet 6 is fed between the platen roller 5 and friction rollers 20*a* and 20*b*. paper sheet 6 is initially set on a hopper 60 (shown in FIG. 11) and then fed into the apparatus with the rotation of the platen roller 5.

Figure 2:
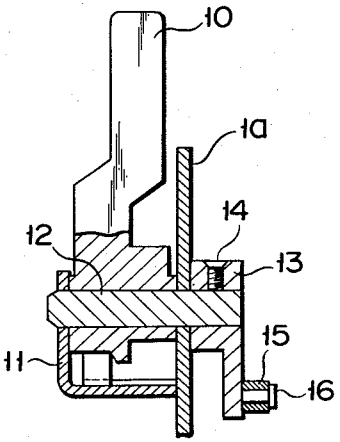
FIG. 2 is a fragmentary sectional view showing the first embodiment.

FIG. 2 is a sectional view showing part of a right frame 1*a* of the printer body 1 shown in FIG. 1. A shaft 12 is rotatably connected to the right frame 1*a* and a support plate 11 fixed to the right frame 1*a*. A roller release lever 10, which is integral with shaft 12, is shown. An upper portion of the roller release lever 10, projecting from the printer body 1, is manually operable. One end of the shaft 12 projects outwardly from the right frame 1*a*. Secured by a screw 14 to the projecting end of the shaft 12 is a drive arm 13 extending parallel to the right frame 1*a*. A roller 15 is rotatably mounted by a pin 16 on the free end of the drive arm 13 such that it extends parallel to the shaft 12. The paper bail rollers 7 are brought into contact with and separated from the platen roller 5 by operating the roller release lever 10, as will be described in detail layer, and, as such, are also referred to as rollers of the roller release lever 10.

Figure 3:
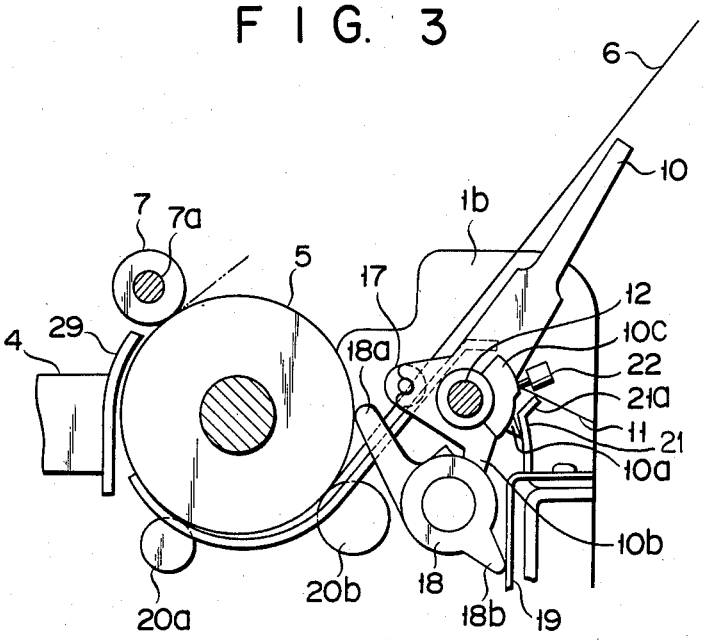
FIGS. 3 and 4 are sectional views showing the first embodiment with a paper bail bar in contact with a platen roller.
Figure 4:
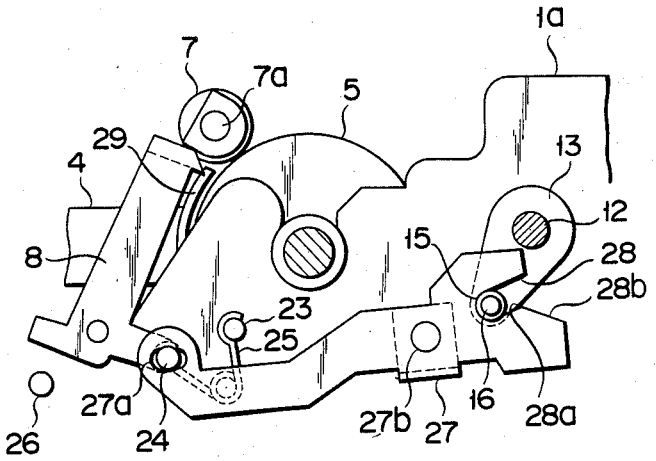
Figure 5:
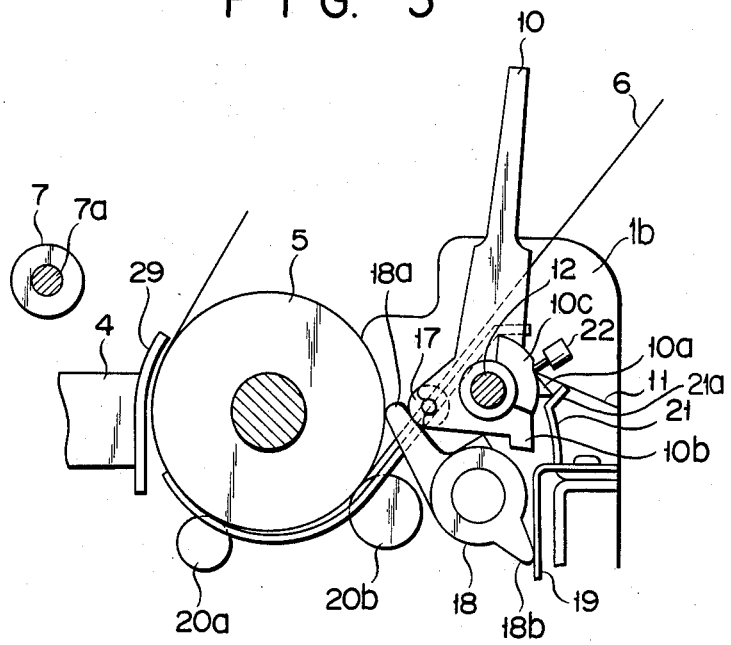
FIGS. 5 and 6 are sectional views showing the first embodiment with the paper bail bar not in contact with the platen roller.

FIGS. 3 to 7 are sectional views showing part of the printer of FIG. 1 as viewed from the right side. As shown in FIGS. 3 and 5, the roller release lever 10 carries a roller 17 rotatably mounted on its lower portion near the platen roller 5. Integral with lever 10 are a protuberance 10*a* formed on the side of its lower portion opposite the platen roller 5, and also a stopper 10*b*, formed at the lower end.

A release arm 18 is rotatably mounted on the right frame 1*a* beneath the roller release lever 10. The release arm 18 has an upper end portion 18*a* engaging the roller 17 and a lower end portion 18*b* in contact with a leaf spring 19 secured to the right frame 1*a*, the leaf spring 19 biasing the release arm 18 in a clockwise direction.

The protuberance 10*a* of the roller release lever 10 is in contact with a leaf spring 21 secured to the right frame 1*a*. It is urged by the leaf spring 21 in the clockwise direction so that the roller release lever 10 is held in the position shown in FIG. 3 with the stopper 10*b* in contact with the release arm 18. When the roller release lever 10 is turned to the position shown in FIG. 5, the roller 17 strikes and is stopped by the upper end portion 18*a* of the release arm 18. At this time, thr roller release lever 10 is held at the position shown in FIG. 5, with the roller release lever 10 being held in the counterclockwise direction by a bent portion 21*a* of the leaf spring 21.

The shaft 12 of the roller release lever 10 has an integral peripheral protuberance 10*c*. A paper bail switch 22 is secured to the right frame 1*a* at a position corresponding to the protuberance 10*c*. The paper bail switch 22 is "on" when the roller release lever 10 is at the position of FIG. 3, and it is "off" when the roller release lever 10 is at the position of FIG. 5.

Figure 6:
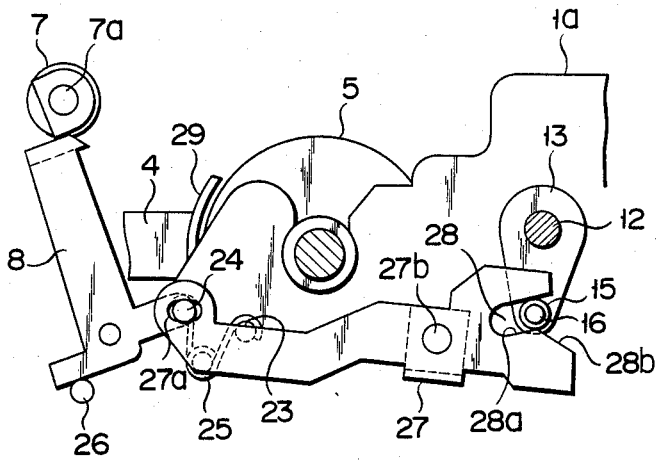

The paper bail rollers 7 are rotatably mounted on the paper bail bar 7*a*, the opposite ends of which are, in turn, mounted on respective paper bail arms 8 rotatably mounted on the right and left frames 1*a* and 1*b* of the printer body 1. As shown in FIGS. 4 and 6, a spring 25 is provided between a support 23 fixed to the right (or left) frame 1*a* (or 1*b*) and a support 24 fixed to the associated paper bail arm 8. The paper bail arms 8 are urged by the spring 25 such that the paper bail rollers 7 are pushed against the platen roller 5 when the paper bail rollers 7 are close to the platen roller 5. In contrast the paper bail arms 8 are held in contact with the stopper 26 when the paper bail rollers 7 are separated from the platen roller 5.

A link 27 is rotatably mounted by a pin 27*b* on the right frame 1*a*. The link 27 has a slot 27*a* formed in its end portion in which the support 24 is engaged. The other end of the link 27 is formed with a notch 28 in which the roller 15 provided on the drive arm 13 is engaged. The notch 28 has a first sloping edge 28*a* sloping upwardly toward the right, and a second sloping edge 28*b* sloping downwardly to the right from the first sloping edge portion 28*a*.

A paper guide 29 is mounted on the carriage 3 at a predetermined distance from the platen roller 5. The paper sheet 6, having been fed from the platen roller 5, is guided by the paper guide 29 upwardly through and between the printing head 4 and platen roller 5. The paper guide 29 has a shape complementary to the outer periphery of the platen roller 5.

FIG. 7 is a schematic sectional view showing the platen roller 5 and nearby components and illustrating the operation of loading a paper sheet 6 in the first embodiment. As shown in the Figure, the paper sheet 6 is pinched btween the platen roller 5 and friction rollers 20*a* and 20*b*, and is fed between the platen roller 5 and printing head 4 by the rotation of the friction rollers 20*a* and 20*b* which rotate with the rotation of the platen roller 5.

Figure 8:
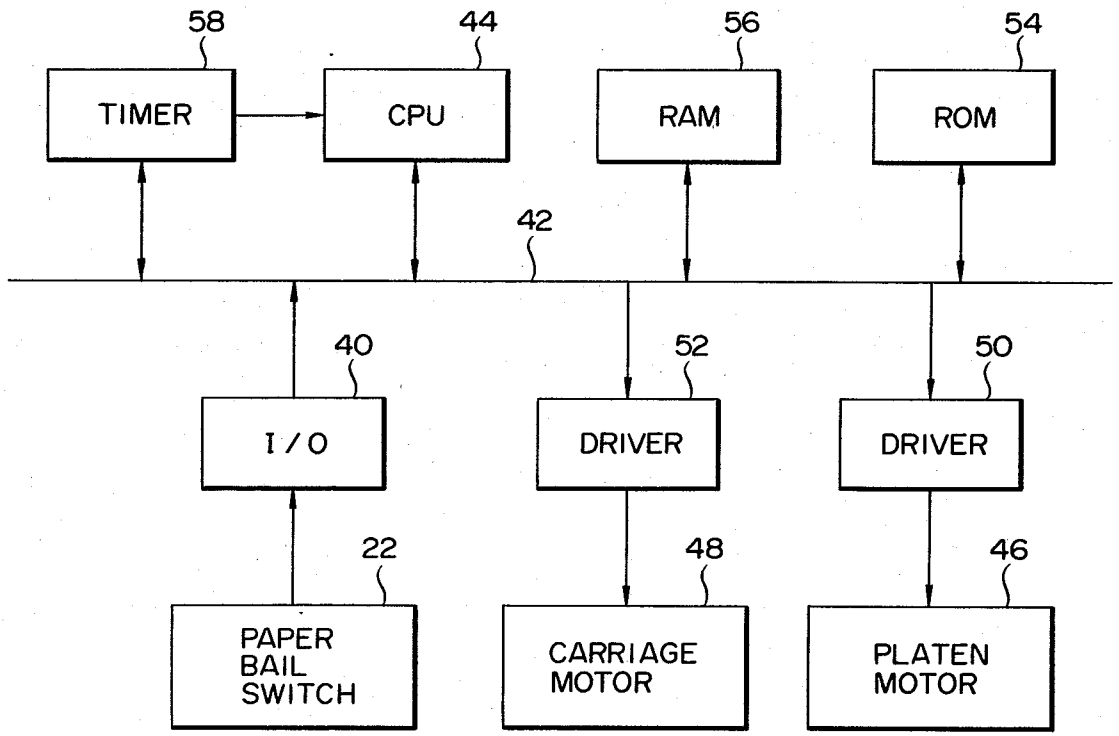
FIG. 8 is a block diagram showing a control circuit of the first embodiment.

FIG. 8 is a block diagram showing a control circuit of the first embodiment. Paper bail switch 22 is connected to a system bus 42 via an I/O port 40. A CPU 44 is also connected to the system bus 42, and an output signal of the paper bail switch 22 is fed to the CPU 44. The CPU 44 generates, according to this output signal, driving signals for driving a platen motor 46 which drives the platen roller 5 for loading a paper sheet 6, and a carriage motor 48 which drives the carriage 3 toward the center of the paper sheet 6. The driving signals from the CPU 44 are fed to the platen and carriage motors 46 and 48 through drivers 50 and 52, respectively. The drivers 50 and 52 convert the respective input signals to signals whose level and timing are suitable for driving of the platen and carriage motors 46 and 48, and then supply the converted signals to these motors 46 and 48. To the system bus 42 are further connected a ROM 54, a RAM 56 and a timer 58. In the ROM 54 are stored programs which are executed in the CPU 44. The RAM 56 is used for temporarily storing data during program execution. In the timer 58 waiting periods of various operations are set, with the timer 58 counting the residual times of these waiting periods.

Figure 10:
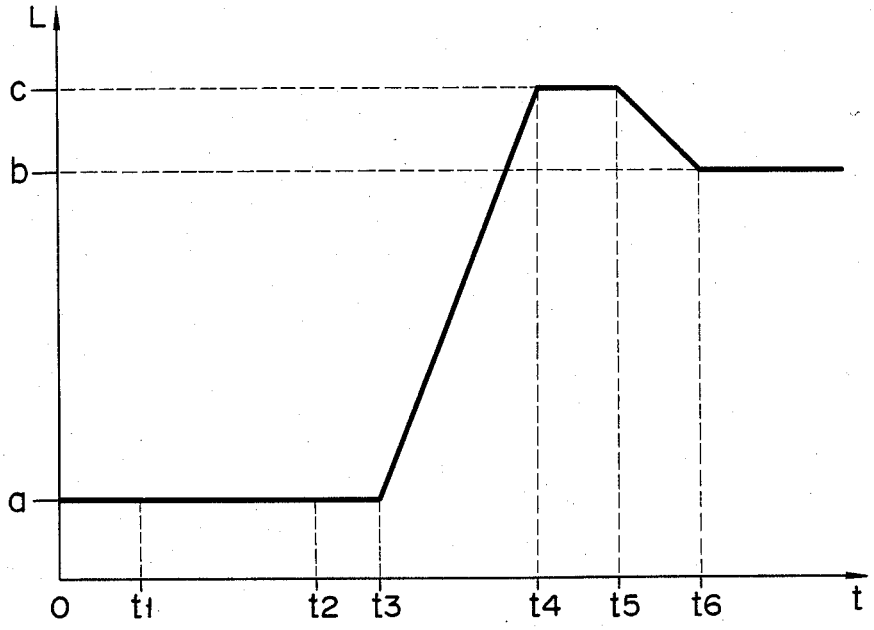
FIG. 10 is a graph showing the position of a paper sheet changing with time in the first embodiment.
Figure 9:
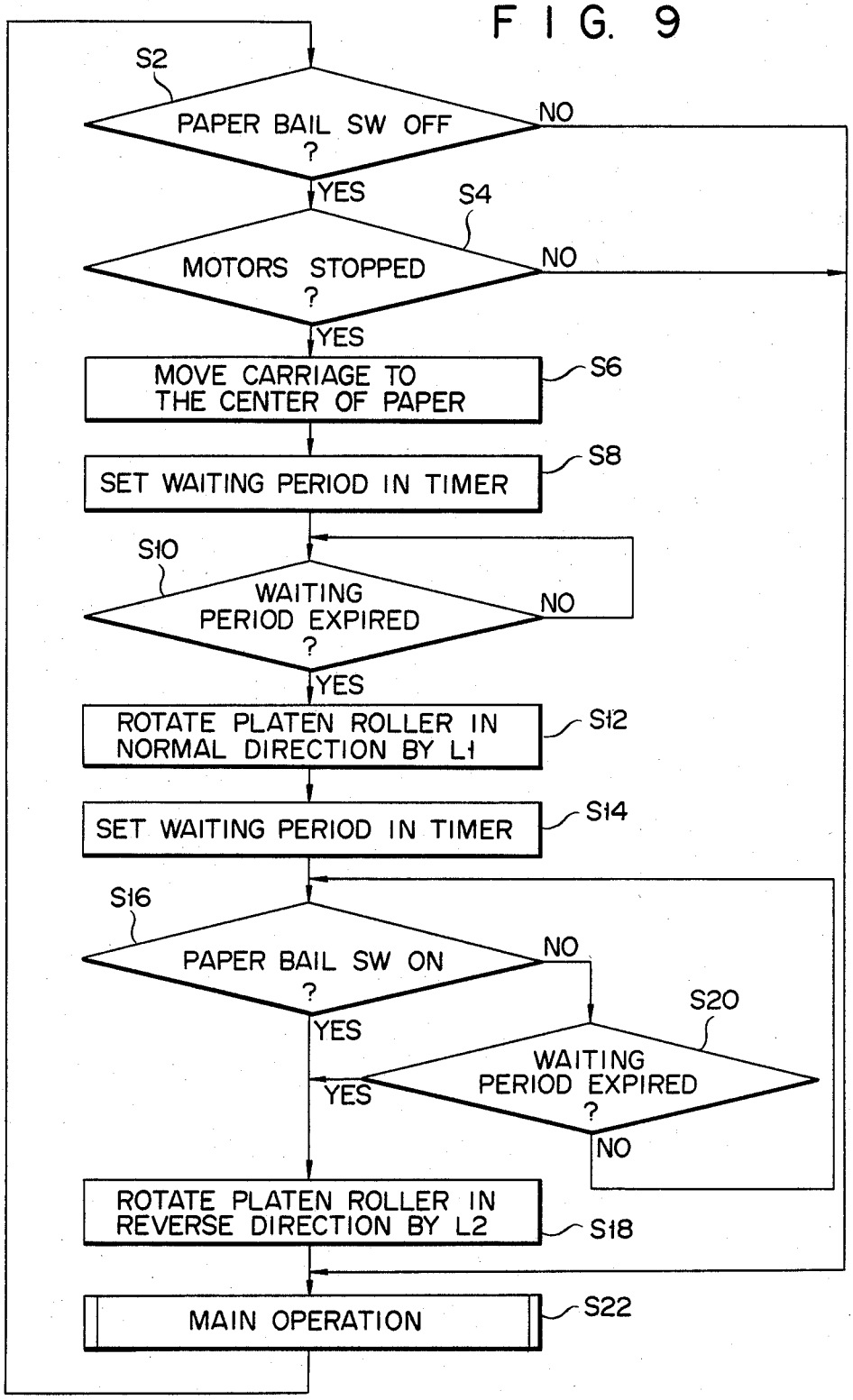
FIG. 9 is a flow chart for explaining the paper sheet loading operation of the first embodiment.

The operation of the first embodiment will now be described with reference to the flow chart of FIG. 9 and graph of FIG. 10. The flow chart of FIG. 9 illustrates an automatic paper sheet loading operation in the form of an interrupt operation with respect to the main operation of the printer. FIG. 10 is a graph showing the position of the paper sheet 6 changing with time t. In step S2 it is determined whether the paper bail roller 7 is not in contact with the platen roller 5. This check is done by checking whether the paper bail switch 22, noted above, is "off". It is assumed that the paper bail bar *7a* is released from the platen roller 5 by the operator after a paper sheet 6 is set on the hopper 60. When the paper sheet 6 is set on the hopper 60, its leading end is in position a shown in FIG. 7. If the paper bail roller 7 is in contact with the platen roller 5, the program returns to step S22 of the printer's main operation. If the paper bail bar *7a* is released from the platen roller 5, step S4 is executed, in which it is determined whether both the platen and carriage motors 46 and 48 are stopped. If at least one motor 46 or 48 is being driven, the program is returned to the main operation (step S22). If both the motors 46 and 48 are stopped, step S6 is executed in which the carriage motor 48 is controlled to move the carriage 3 to the center of the paper sheet 6. The period of movement of the carriage 3 is between instants t1 and t2 shown in FIG. 10. With this action, the paper sheet 6 can be wound on the platen roller 5 by the paper sheet guide 29 provided on the printing head 4. In a subsequent step, step S8, a waiting period, which is a constant period, is set in the timer 58. This is done because there is a time delay between the instant when the paper bail bar *7a* is released from the platen roller 5 and the instant when the paper bail switch 22 is tuned off. In a subsequent step, S10, it is determined whether the waiting period has expired. When the waiting period (between instants t2 and t3 shown in FIG. 10) has expired, step S12 is executed and the platen motor 46 is rotated in the normal direction (i.e., clockwise direction in FIG. 7) for a constant period. During this period (between instants t3 and t4 in FIG. 10), the platen roller 5 is rotated by an amount L1, as shown in FIG. 7, so that the leading end of the paper sheet 6 reaches the position c. It is assumed that the paper bail roller 7 is subsequently brought to a state in contact with the platen roller 5 by the operator. In a subsequent step, S14, a constant period is set in the timer 58. This is done in order that the subsequent operation be executed after the lapse of the constant time even if the paper bail roller 7 is not in contact with the platen roller 5. In a subsequent step, S16, it is determined whether the paper bail roller 7 is in contact with the platen roller 5. If the paper bail roller 7 is in contact with the platen roller 5, step S18 is immediately executed. Since the leading end of the paper sheet 6 has passed the position of the paper bail bar *7a*, with the paper bail roller 7 being in contact with the platen roller 5, the paper sheet 6 is securely pinched between the paper bail rollers 7 and platen roller 5. If the paper bail bar *7a* is released from the platen roller 5, it is determined whether the waiting period (between instants t4 and t5 shown in FIG. 10) has expired in step S20. When it is determined that the waiting period has expired, step S18 is executed in which the platen motor 46 is rotated in the reverse direction for a constant period. During this period (between instants t5 and t6 in FIG. 10) the platen roller 5 is rotated in reverse by an amount of L2 shown in FIG. 7. This brings to an end the loading of the paper sheet 6. Since the leading end of the paper sheet 6 is accurately positioned between the platen roller 5 and paper bail roller 7 (position b), the paper sheet 6 is perfectly wound on the platen roller 5 and the waste area of the paper sheet 6, which is not provided for printing, can be minimized. Subsequently, the program returns to the main operation (step S22).

As has been shown, automatic loading of the paper sheet 6 can be obtained by merely incorporating a single paper bail switch 22 for detecting the contact of the paper bail roller 7 with the platen roller 5 and an input circuit thereof. In other words, the paper bail bar 7a must be manually contacted with or separated from the platen roller 5, and it is this manual operation that is detected, making it possible to omit an extra operation of turning on a load switch; hitherto a necessity.

Figure 11:
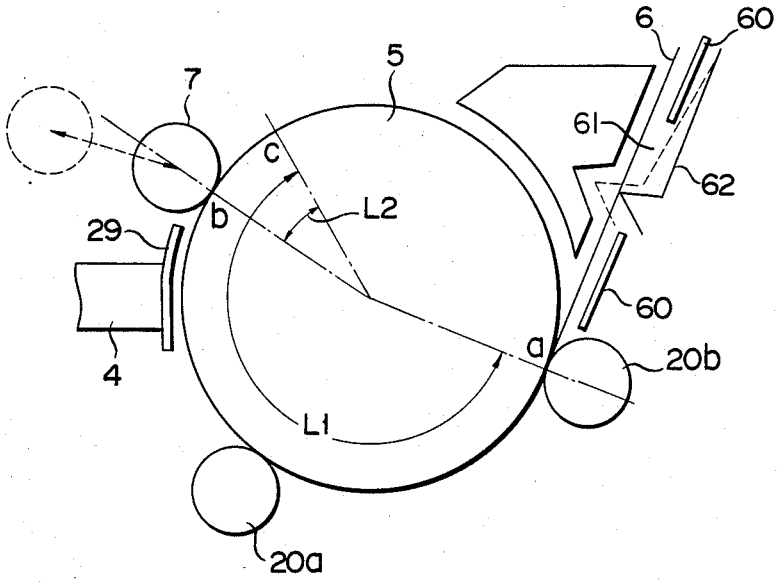
FIG. 11 is a sectional view showing a platen roller and neighboring components in a second embodiment of the invention.

Now, a second embodiment of the invention will be described. In the preceding first embodiment, the paper bail bar *7a* is released from the platen roller 5 by the operator when a paper sheet 6 is set on the hopper 60. However, since there is no means for detecting the presence of absence of the paper sheet 6 on the hopper 60, it is possible that the paper bail roller 7 may be in contact with the platen roller 5 without any paper sheet 6 set on the hopper 60. In such a case, idle paper loading is caused with the start of rotation of the platen roller 5. In addition, it is likely that overlap loading after a paper sheet 6 has been loaded may occur. The second embodiment is an improvement over the first embodiment in order to prevent the occurrence of such undesired operations. FIG. 11 shows an essential part of the second embodiment. FIG. 11 corresponds to FIG. 7 showing the first embodiment. In the second embodiment, a hopper 60 is provided with a slit or an opening 61, and a no-paper detector 62 is provided to detect the presence or absence of a paper sheet 6 on the hopper 60. The detector 62 is made of a member having a restoring property, e.g., a spring. When a paper sheet 6 is set on the hopper 60, the member 62 is retracted by the sheet 6 to turn on a switch (not shown), whereby the setting of the paper sheet 6 is detected. When there is no paper sheet 6 set on the hopper 60, the member 62 is in its advanced position, and the switch is "off", detecting the absence of a paper sheet 6. The other mechanical constructions are the same as in the first embodiment.

Figure 12:
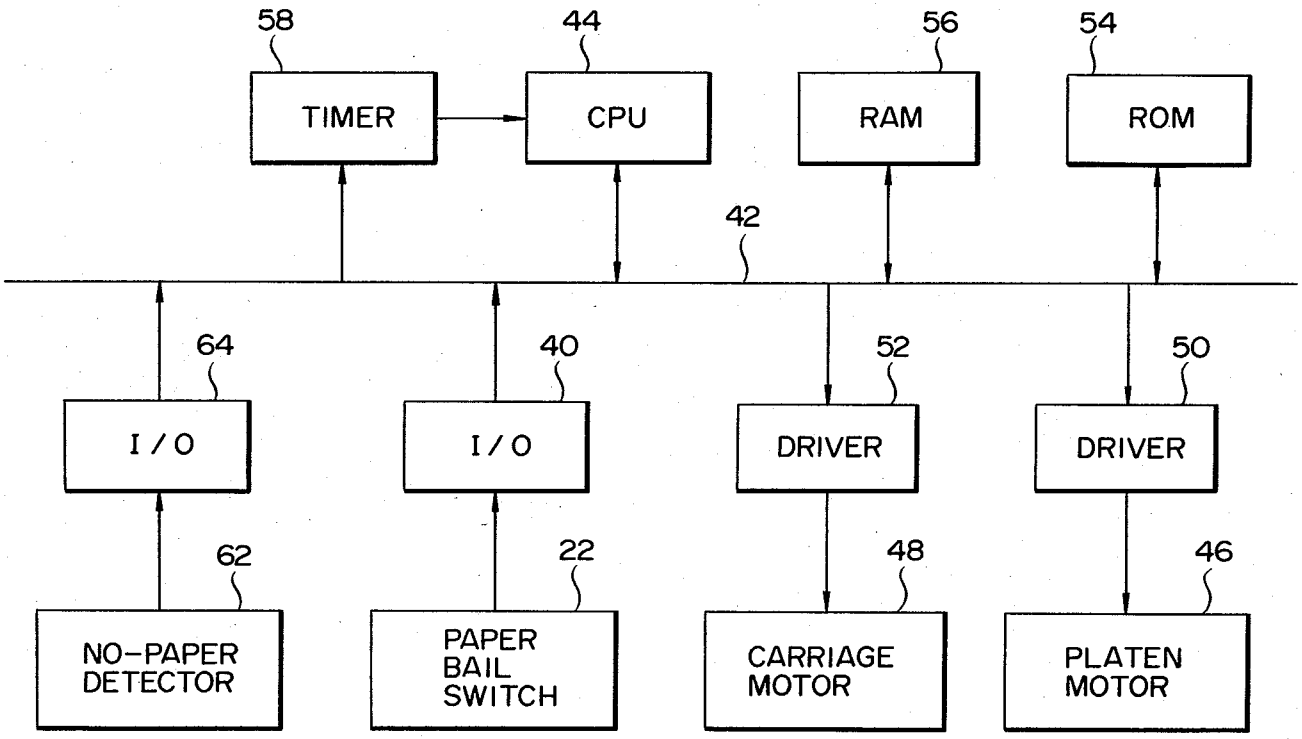
FIG. 12 is a block diagram showing a control circuit of the second embodiment.

FIG. 12 is a block diagram showing a control circuit of the second embodiment. This control circuit is the same as that in the first embodiment except for that a no-paper detector 62 is further connected to a system bus 42 via an I/O port 64.

Figure 13:
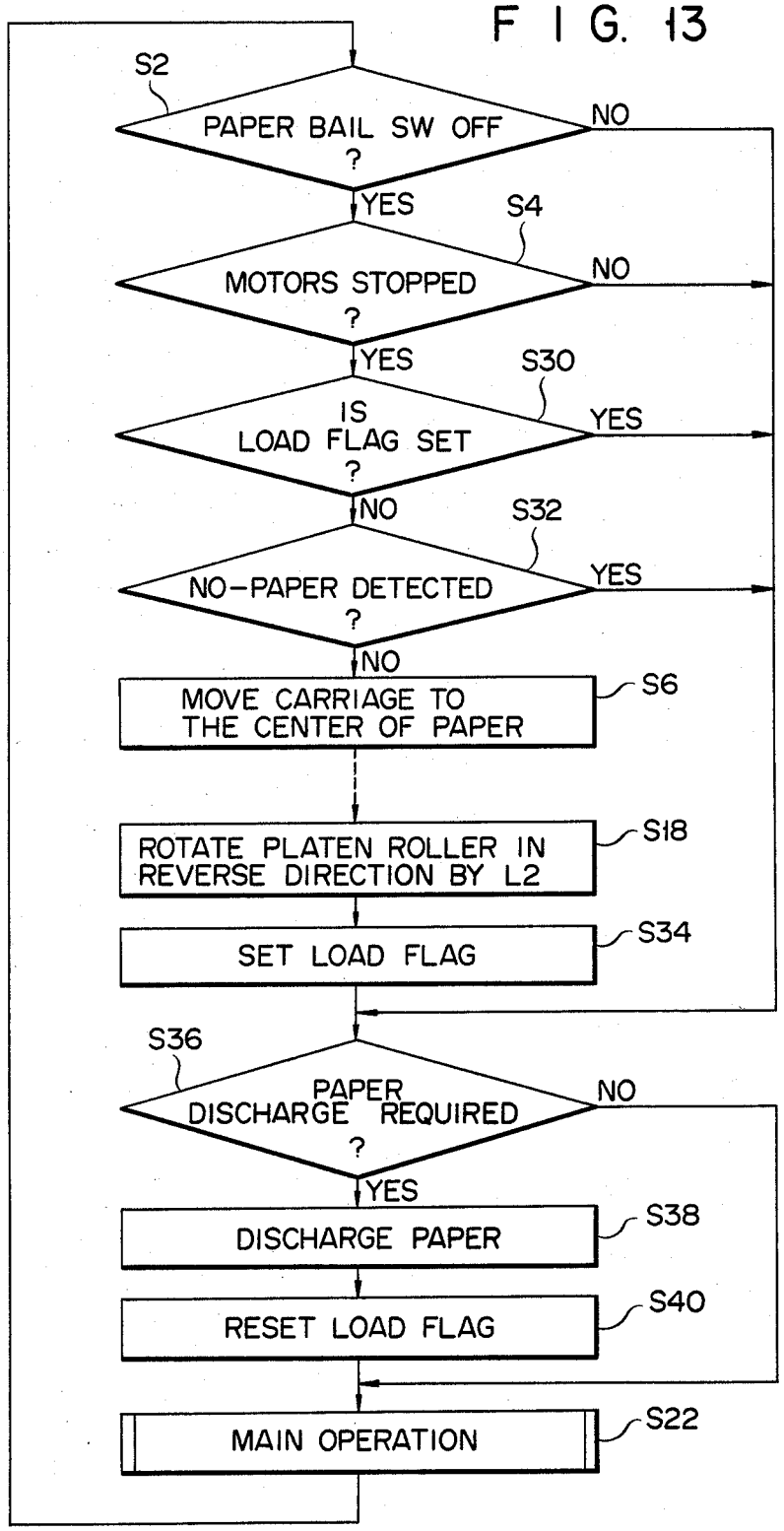
FIG. 13 is a flow chart explaining the paper sheet loading operation of the second embodiment.

The operation of the second embodiment will now be described with reference to the flow chart of FIG. 13. The operation of the second embodiment includes the same operation as that of the first embodiment, and steps corresponding to those in the flow chart of FIG. 9 are designated by like reference symbols and are not described further. The automatic paper loading operation, like that of the first embodiment, is started when it is detected in step S2 that the paper bail bar *7a* has been released from the platen roller 5. In the case of the first embodiment, the driving of the carriage and platen motors 46 and 48 is started as soon as the paper bail bar *7a* is released from the platen roller 5. In the second embodiment, however, after it is detected in step S4 that the motors 46 and 48 are stopped, it is determined in step S30 whether there is a paper sheet 6 that has been loaded in the printer. This is done by checking whether a load flag is set, it being set after the completion of paper sheet loading, and reset when the paper sheet 6 is discharged from the printer, as described later. When the load flag is reset, i.e., when there is no paper sheet 6 loaded in the printer, it is determined in step S32 whether a paper sheet 6 is set on the hopper 60. With the retraction of the spring member of the no-paper detector 62, it is detected that a paper sheet 6 is set on the hopper 60. That is, when and only when it is detected that there is no loaded paper sheet 6 in the printer but that there is a paper sheet 6 set on the hopper 60, the carriage and platen motors 46 and 48 are driven in steps S6 through S18 to load the paper sheet 6. When the reverse rotation of the platen roller 5 in step S18 is completed, a load flag is set in step S34. In a subsequent step, S36, it is determined whether there is a paper discharge request. If a decision "NO" yields in step S2 or S4, or a decision "YES" yields in step S30 or S32, the step S36 is immediately executed. If the discharge of paper sheet 6 is not necessary, the program goes back to the main operation step S22. If it is necessary to discharge a paper sheet 6, step S38, in which the platen motor 48 is rotated in the normal direction for a predetermined period of time, is executed, whereby the paper sheet 6 is discharged. In a subsequent step, S40, the load flag is reset to permit the loading of the next paper sheet 6. The program then returns to the main operation step S22.

In the second embodiment, as described above, the loading operation is prevented if no paper sheet 6 is set on the hopper 60 or there remains a loaded paper sheet 6 in the printer. Thus, idle paper feeding and overlap loading is eliminated.

As has been described in the foregoing, according to the invention, it is possible to provide a printing apparatus having excellent operability and wherein a cut paper sheet 6 is automatically loaded merely by separating the paper bail bar *7a* from the platen roller 5.

The above embodiments of the invention are by no means limitative, and various changes and modifications are possible. For example, the roller release lever 10 for releasing or separating the paper bail bar *7a* from the platen roller 5 may be omitted, and the paper bail bar *7a* may be directly separated by hand. Further, the paper bail switch 22 and no-paper detector 62 may be variously changed in construction.

What is claimed is:

1. A sheet loading device for a printing appartus having a platen roller and a paper bail roller manually movable in and out of contact with the platen roller, the device comprising:

means for positioning the leading end of a sheet at a predetermined position on the platen roller;

means for detecting whether the paper bail roller is in or out of contact with the platen roller; and paper loading means responsive to said detecting means for rotating the platen roller in a normal direction through a first predetermined angle when said detecting means detects that the paper bail roller is manually moved out of contact with the platen roller, and then rotating the platen roller in a reverse direction opposite the normal direction through a second predetermined angle.

2. The device according to claim 1, wherein said paper loading means rotates the platen roller in the reverse direction through said second predetermined angle when said detecting means detects that the paper bail roller is in contact with the platen roller after the platen roller has been rotated in the normal direction through said first predetermined angle.

3. The device according to claim 1, further comprising timer means for detecting when a predetermined period of time has elapsed after the platen roller has been rotated in the normal direction through said predetermined angle, and wherein said paper loading means rotates the platen roller in the reverse direction through said second predetermined angle when said timer means detects that said predetermined period of time has elapsed after the platen roller has been rotated in the normal direction through said first predetermined angle.

4. A sheet loading device for a printing apparatus, comprising:

a hopper for setting a cut paper sheet thereon;

a platen roller for feeding said cut sheet set on said hopper;

a friction roller for positioning the leading end of the cut sheet on said hopper at a predetermined position on said platen roller;

a paper bail bar having a paper bail roller used in conjunction with said platen roller to secure the cut paper sheet against said platen roller;

first detecting means for detecting whether a cut paper sheet is set on said hopper;

flag means for detecting whether a cut paper sheet is secured against said platen roller;

second detecting means, interlocked to said paper bail bar, for detecting whether said paper bail roller is in contact with said platen roller; and paper loading means responsive to said first and second detecting means and said flag means, for rotating said platen roller in a normal direction through a first predetermined angle when said first detecting means detects that a cut paper sheet is set on said hopper, said flag means detects that no cut paper sheet is secured against said platen roller, and said second detecting means detects that said paper bail roller is manually moved out of contact with said platen roller, and then for rotating said platen roller in a reverse direction opposite the normal direction through a second predetermined angle, said first predetermined angle being the sum of said second predetermined angle and an angle measured between said predetermined position on said platen roller and the contact point of said platen roller and said paper bail roller.

5. The device according to claim 4, wherein said paper loading means rotates said platen roller in the reverse direction through said second predetermined angle when said second detecting means detects that said paper bail roller is in contact with said platen roller after said platen roller has been rotated in the normal direction through said first predetermined angle.

6. The device according to claim 4, further comprising a timer means for detecting when a predetermined period of time has elapsed after the platen roller has been rotated in the normal direction through said first predetermined angle, and wherein said paper loading means rotates the platen roller in the reverse direction through said second predetermined angle when said timer means detects that said predetermined period of time has elapsed after the platen roller has been rotated in the normal direction through said first predetermined angle.

7. The device according to claim 4, further comprising a printing head reciprocably movable along said platen roller, said printing head being brought to a position corresponding to the center of a cut paper sheet in the width direction thereof before rotation of said platen roller in the normal direction through said first predetermined angle, said printing head including guide means for causing the cut paper sheet to be wound on said platen roller when said platen roller is rotated in the normal direction through said first predetermined angle.

* * * * *